US007159634B1

(12) United States Patent
Judkins

(10) Patent No.: US 7,159,634 B1
(45) **Date of Patent: *Jan. 9, 2007**

(54) PLEATED AND CELLULAR MATERIALS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 1019 days.

This patent is subject to a terminal disclaimer.

(21) Appl. No.: 09/017,392

(22) Filed: Feb. 2, 1998

Related U.S. Application Data

(63) Continuation-in-part of application No. 08/756,282, filed on Nov. 25, 1996, which is a continuation of application No. 08/412,875, filed on Mar. 29, 1995, now Pat. No. 5,630,898.

(51) Int. Cl.
*E06B 3/48* (2006.01)

(52) U.S. Cl. ..... 160/84.05; 156/197; 428/116

(58) Field of Classification Search ..... 160/84.01, 160/84.04, 84.05; 156/193, 197; 428/116, 428/118

See application file for complete search history.

(56) References Cited

U.S. PATENT DOCUMENTS

| | | | | |
|---|---|---|---|---|
| 2,803,578 A | | 8/1957 | Holland | 154/122 |
| 4,450,027 A | * | 5/1984 | Colson | 156/193 |
| 4,673,600 A | * | 6/1987 | Anderson | 428/12 |
| 4,676,855 A | | 6/1987 | Anderson | 156/193 |
| 4,685,986 A | | 8/1987 | Anderson | 156/197 |
| 4,974,656 A | | 12/1990 | Judkins | 160/84.1 |
| 4,999,073 A | | 3/1991 | Kao et al. | 156/197 |
| 5,015,317 A | * | 5/1991 | Corey et al. | 156/197 |
| 5,043,038 A | | 8/1991 | Colson | 156/193 |
| 5,106,444 A | | 4/1992 | Corey et al. | 156/197 |
| 5,160,563 A | | 11/1992 | Kutchmarek et al. | 156/197 |
| 5,193,601 A | | 3/1993 | Corey et al. | 160/84.1 |

FOREIGN PATENT DOCUMENTS

| | | |
|---|---|---|
| CA | 2144280 | 9/1995 |

* cited by examiner

*Primary Examiner*—Blair M. Johnson
(74) *Attorney, Agent, or Firm*—Buchanan Ingersoll PC

(57) ABSTRACT

A tabbed honeycomb structure or pleated panel is made from a stack of collapsed multi-cellular material. The stack is split at bond lines thereby forming the panels of pleated or honeycomb material having a joint tab on one face. The tabbed, honeycomb material is attached between a headrail and a bottomrail to form a window covering.

46 Claims, 5 Drawing Sheets

FIG. 4
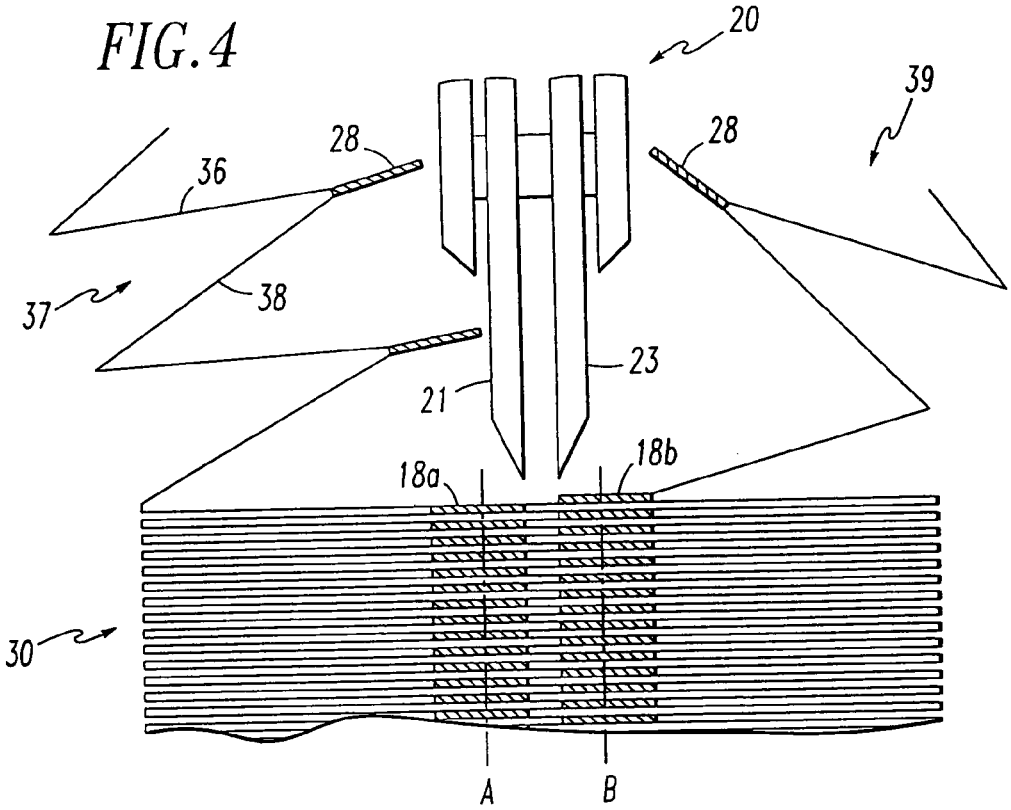
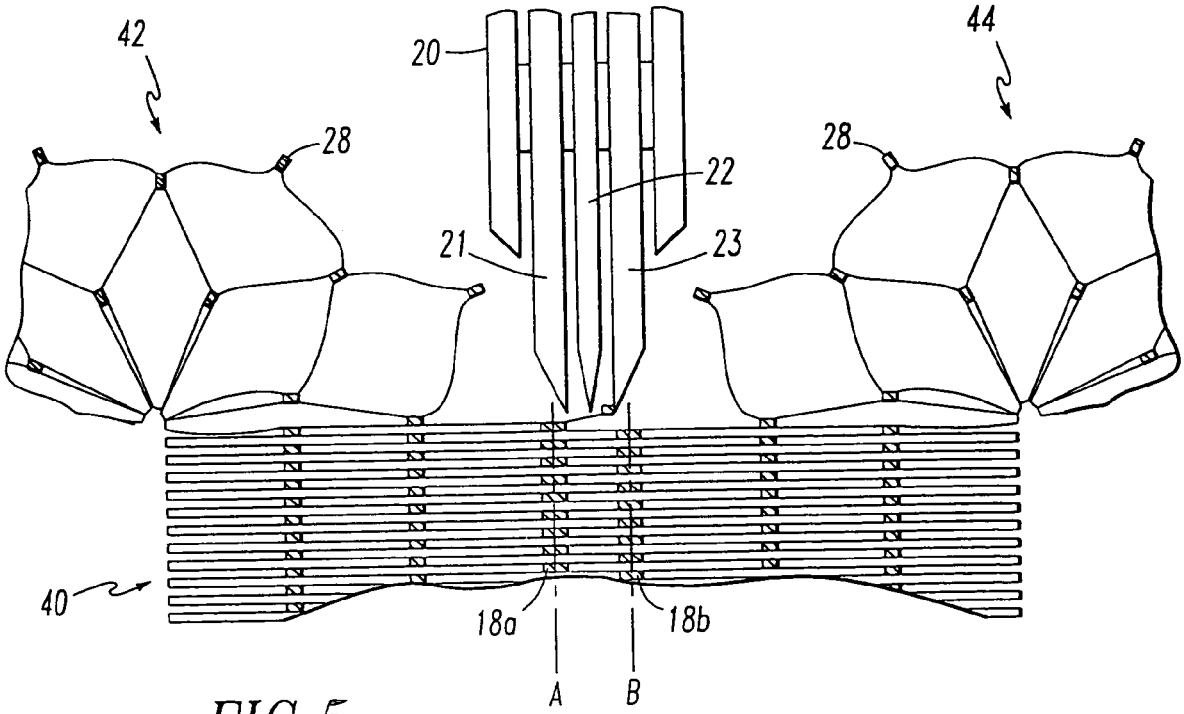
FIG. 5

PLEATED AND CELLULAR MATERIALS

CROSS-REFERENCE TO RELATED APPLICATIONS

This is a continuation in part of U.S. patent application Ser. No. 08/756,282 filed Nov. 25, 1996, which is a continuation of U.S. patent application Ser. No. 08/412,875, filed Mar. 29, 1995, and issued as U.S. Pat. No. 5,630,898 on May 20, 1997.

BACKGROUND OF THE INVENTION

1. Field of the Invention

This invention relates to a tabbed and pleated cellular material and method for the manufacture thereof and more particularly to a window covering which contains this tabbed and pleated cellular material.

2. Description of the Prior Art

There are two basic types of folded window coverings. A first pleated type consists of a single layer of corrugated material. The other is a more complex cellular type where pleated layers are joined or folded strips are stacked to form a series of collapsible cells. This latter type is known to have favorable thermal insulation properties because of the static air mass which is trapped between the layers of material when the cells are in the expanded position. The single-layer type, on the other hand, is favored for its appearance in some cases, and is less expensive to manufacture. There is also a tabbed single layer of corrugated material which is disclosed in my U.S. Pat. No. 4,974,656. The tabbed single layer of pleated material has been sold in window coverings and been commercially successful. Consequently, there is a market for a window shade made with a tabbed cellular material.

There are two basic approaches to making cellular products and tabbed panels from a roll of fabric material. The first method pleats or bonds the material transverse to the length of the roll and the second method pleats or bonds longitudinally along its length.

The output of the transverse method cannot be wider than the roll width of the original material. The longitudinal method is limited in the types of patterns that can be printed on the material because alignment is random. The transverse methods have been limited to a single layer, a single tabbed layer or a triple layer where there are three continuous surfaces that create a panel of double cells.

There is a need to have a transverse process that can make a panel of single cells. There is also a need to increase the speed of production output of single, double and triple layers.

There are several methods of producing the cellular shades. Most similar to the pleated, single-panel method is Anderson U.S. Pat. No. 4,685,986. This method joins together two single-panel pleated lengths of material by adhesively bonding them together at opposing pleats. Other methods depart from this Anderson patent by joining together a series of longitudinally folded strips, rather than continuous sheets of pleated material. Such methods are shown in Colson U.S. Pat. No. 4,450,027, and in Anderson U.S. Pat. No. 4,676,855. In the Colson patent, strips of fabric are longitudinally folded into a U-shape and adhered on top of one another, whereas in the Anderson patent these strips are Z-shaped and are adhered in an interlocking position.

In U.S. Pat. No. 5,043,038 Colson discloses a method of cutting a honeycomb structure longitudinally to divide them into two tabbed single layer pleated panels. That honeycomb structure was formed from U-shaped strips as taught in Colson's U.S. Pat. No. 4,450,027 by a process of winding the foldable material around a base apparatus, applying glue to one face of the material and adhering each layer to the adjacent layer. This method tends to cause the tab to wrinkle because the stack is wrapped on a slightly curved mandrel. Also, because the material layers are wound in a stack, the length of the panels of final product are limited to the height of the wrapped stack and the ends of the stack are wasted.

Another method for making cellular shades is disclosed in U.S. Pat. Nos. 5,015,317; 5,106,444 and 5,193,601 to Corey et al. In that process fabric material is run through a production line that first screen prints the fabric and then applies thermoplastic glue lines at selected intervals. The fabric is then pleated, stacked, and placed in an oven to both set the pleats and bond the material at the glue lines.

There is a need for a method to utilize the current transverse processing equipment technology to make a larger variety of single and multi-layer panels at a faster rate.

SUMMARY OF THE INVENTION

The present method overcomes the problems and achieves the objectives indicated above by providing a method of manufacturing a pleated shade or a honeycomb structure by a means of splitting honeycomb or multicellular material into two or more tabbed, pleated panels or tabbed, cellular panels.

According to the teachings of the present invention, a stack of folded fabric is bonded to form a honeycomb structure having a series of cells connected together along bond lines. An interface region is present between adjacent cells which forms the bridge between horizontally adjacent stacks of cells. At least one bond line applied between adjacent fabric walls defines each interface region. These interface regions are split to form separate tabbed, pleated panels or separate panels of cells having tabs on one face between each pair of pleats. These tabs extending between each pleated panel or between individual cells, as the case may be, extend at least 1/16" in length. To simplify handling and to create a uniform appearance the tabs are identical in size resulting from a straight-line split along a distinct perpendicular plane, but the invention is not limited to this.

The tabbed cellular material is attached between a headrail and a bottomrail to form a window covering. Lift cords are routed from the bottomrail, through the cellular material and through the headrail for raising and lowering the window covering.

BRIEF DESCRIPTION OF THE DRAWINGS

FIG. 4 is a diagram showing a double cell honeycomb stack being split into tabbed panels.

FIG. 5 is a diagram of a five cell honeycomb stack being split into two double honeycomb panels having tabs which are formed on one face of both panels.

DESCRIPTION OF THE PREFERRED EMBODIMENTS

Figure 1:
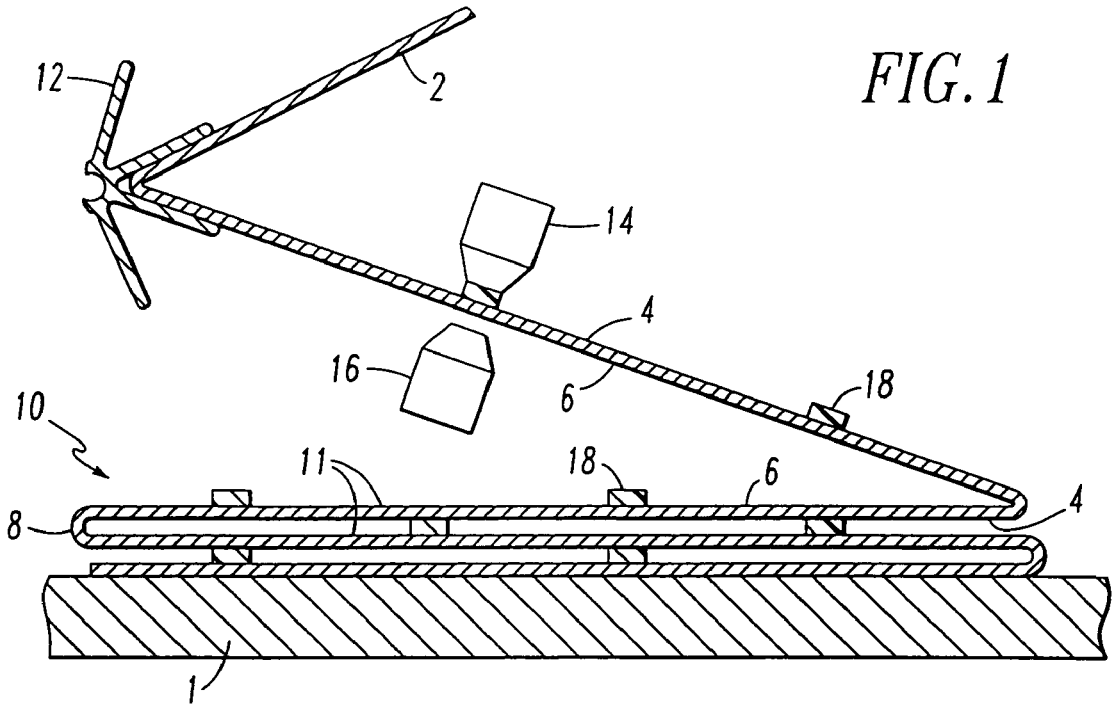
FIGS. 1 and 2 are diagrams showing how the honeycomb stack is formed.
Figure 2:
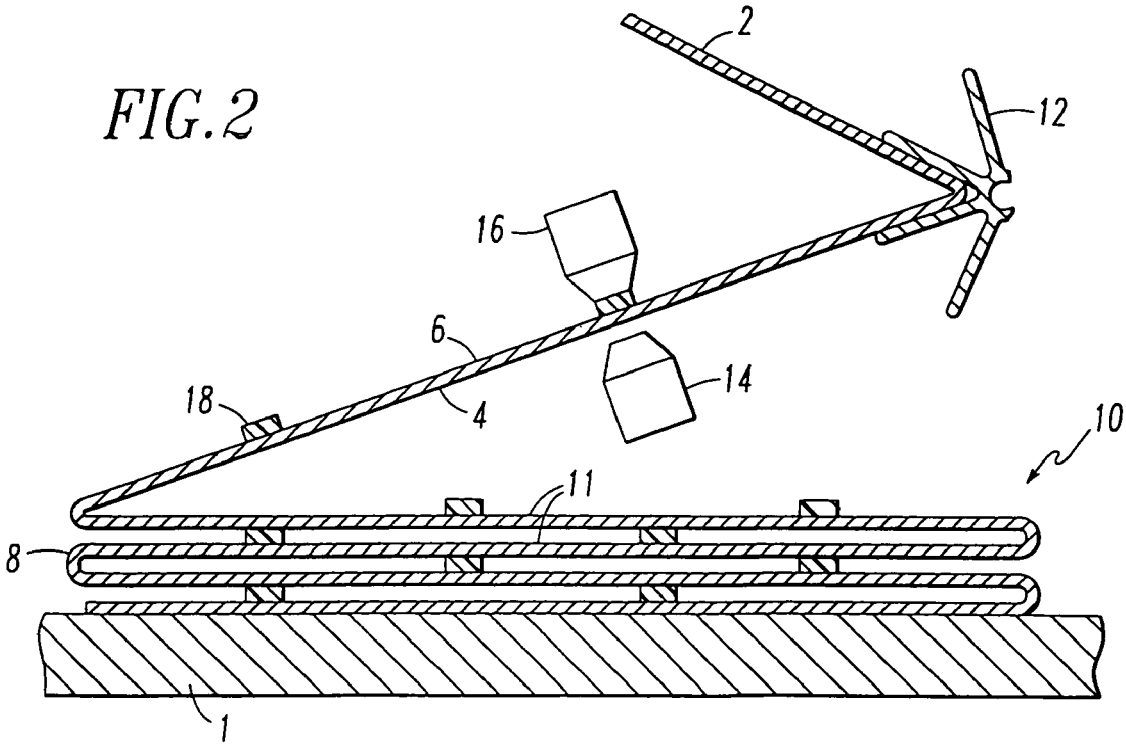

Referring to FIGS. 1 and 2, I provide a sheet of pleated fabric 2 which is folded on work surface 1 to form a fabric stack 10. Pleated fabric 2 is delivered to the work surface by a sprocket or other feed mechanism 12 which draws the fabric from a source of supply which is not shown. Glue applicators 14 and 16 apply bond lines 18 of hot melt glue on a surface 4 of the fabric. When the fabric is in the position shown in FIG. 1 surface 4 is facing upward. After the fabric has been laid from right to left across the length of stack 10, the fabric is folded as shown in FIG. 2. The movement of the stack relative to the fabric being supplied folds the fabric 2 back over the stack forming a pleat 8. Now surface 4 is facing down and opposite surface 6 is facing up. In that position glue applicator 16 applies lines of glue on surface 6. The fabric is laid across the stack from left to right. The process is repeated until a complete stack of fabric 10 has been created. That stack will then have sets of bond lines in vertical planes transverse to the pleat faces. Then, the stack is placed in an oven to melt the glue and bond the pairs of opposing faces together. If desired, irons could be provided to press the pleats after a selected number of passes. Although I prefer to create bond lines using an adhesive, particularly a hot melt adhesive, it is also possible to create the bond lines using a heat welder. After each pair of opposed pleat faces is laid they are welded together. I have found that a heat welder will bond two overlying sheets without affecting a third sheet below the sheets which are bonded.

In FIGS. 1 and 2 I show the adhesive lines being applied to pleated fabric. If desired, one can apply the adhesive to the fabric first and then pleat the fabric.

Figure 3:
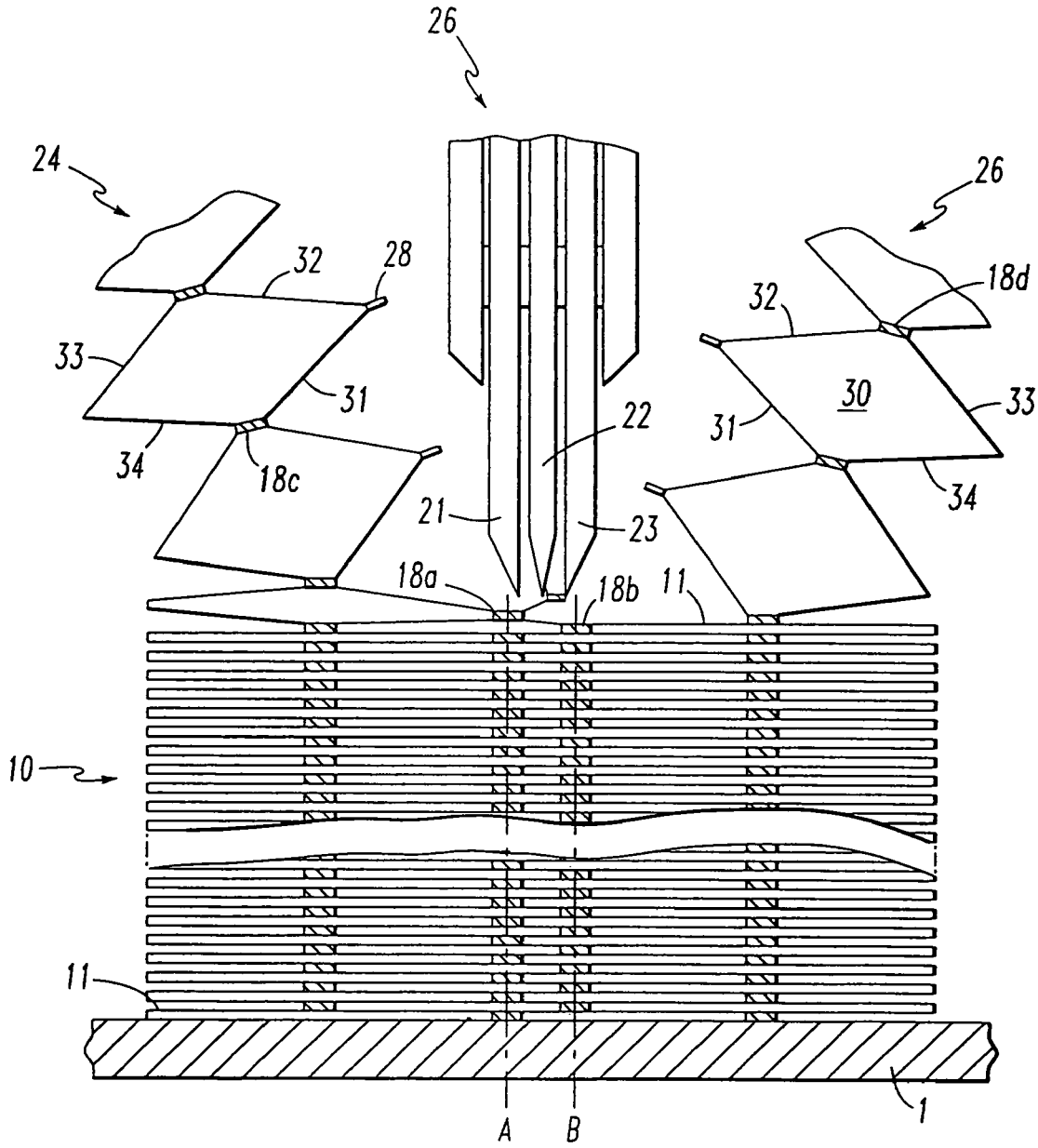
FIG. 3 is a diagram showing a triple cell honeycomb stack being split into two tabbed honeycomb panels according to the teachings of the present invention.

Referring now to FIG. 3, a splitter 20 is positioned above the stack so that blades 21 and 23 are positioned directly above adjacent glue lines 18*a* and 18*b*. Splitter 20 is then moved through the stack thereby cutting the stack along the glue lines. These cuts form two single cell honeycomb panels 24 and 26. Preferably, the knife cuts between two planes of glue lines A and B so that after cutting the set of glue lines 18*a* in plane A are in one panel 24 and the set of glue lines 18*b* in plane B are in a second panel 26. Alternatively, the knife could cut through a plane of glue lines so that a portion of each glue line is in each panel. Each cell 30 has four primary side walls 31, 32, 33 and 34 and two parallel walls to which adjacent cells are attached forming a six-sided polygon shown in FIG. 3. Because of the method of manufacture a tab 28 has been formed between adjacent pleat faces or cell sidewalls 32 and 33 and contrast opposite side walls 33 and 34 meet to form a standard pleat, fold or crease. Adjacent cells are connected together by glue lines 18*c* and 18*d* at attachment zones, or interconnection zones as shown by FIG. 3. I prefer to provide a standard pleat face of ½" with a ¼" bridge formed by glue lines 18*c* and 18*d*. Preferably the tab has a width of 1/16" creating an overall width of 1 5/16". The region between glue lines 18 and 18*b* is preferably ⅛". Thus, the width of stack 10 would be 2¾" to make two panels of this preferred fabric size. Other standard sizes of pleat faces ranging from ¼" to about 1" can easily be made with this process. Indeed, the pleats can be any desired size.

I prefer that cutter 20 have two outside knives 21 and 23 and one inside knife as shown in FIG. 3. The use of two outside knives allows for a better cutting of the glue lines and for a greater tolerance for error of a glue plane placement and thickness. The center knife cuts the accordion pleat remnant in half so that the resulting smaller strips can easily be drawn off by vacuum.

FIG. 4 shows a double cell honeycomb stack 30 being split. The cells are formed by sets of glue lines 18*a* and 18*b* in planes A and B. The double cells are split by knives 21 and 23 along a perpendicular plane through the glue lines. This method forms two panels of pleated material 32 and 34 each having a joint tab 28 on one face between each pair of adjacent pleat faces 36 and 38. The joint tabs 28 extending between each pair of pleats preferably should measure at least 1/16" in length.

FIG. 5 is a diagram of a five-cell honeycomb stack 40 being split. The five-cell honeycomb stack is split along a cutting plane parallel to the planes A and B containing glue lines 18*a* and 18*b*. This method forms two panels 42 and 44 of double cell honeycomb material having tabs 28 on one face. The splitter shown in FIG. 5, generally designated as 20, is comprised of a center blade 22 which pierces the stack 40 and two blades 21 and 23 that cut the interior edge of each alternating adhesive bond lines 18*a* and 18*b*.

Although I have shown the tabs being formed from a single glue line, tab 28 may be formed by either means of a single or a double bond or line of adhesive sometimes called an adhesive strip or glue bead depending upon how the glue is applied. The joint tabs in the separated panels in the figures are the same size. However, this is not necessary. Also, I have shown the glue lines extending to the ends of the tabs. But, this is not necessary.

A major advantage of the present method over the prior art is the gluing machine can make two, tabbed, pleated layers; two, tabbed, single-cells; or two tabbed, double-cell layers by changing the pump pressure and the orifice configuration on the glue heads. Such a change can be made in less than hour. Since the splitter is much faster and simpler than the gluing process, it is a less expensive machine and can handle the output of 3 or 4 gluing machines.

The stack of the present invention can be formed on several types of prior art pleating machines modified to have glue heads and to fold the fabric into the stack after gluing, or by simply modifying the glue heads on machines which have them to place more glue lines at different intervals. Such modified machines should be able to put out nearly twice the effective output than they did prior to modification.

Figure 6:
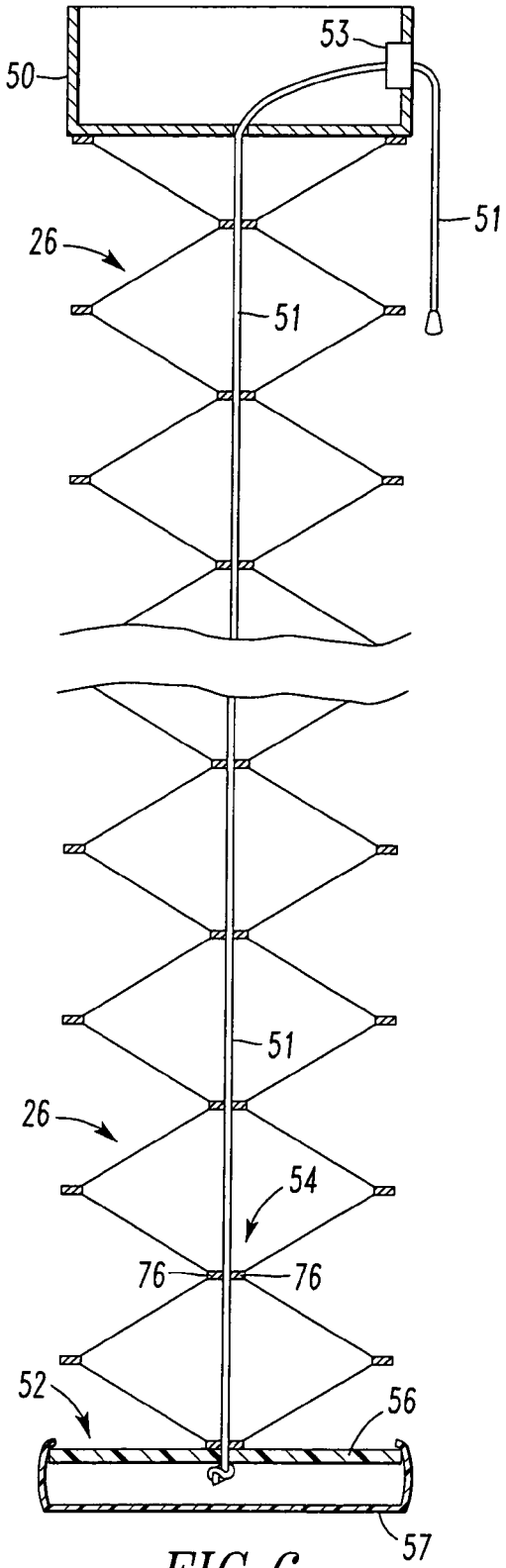
FIG. 6 is a side view of a window covering made from tabbed, single cell material.
Figure 9:
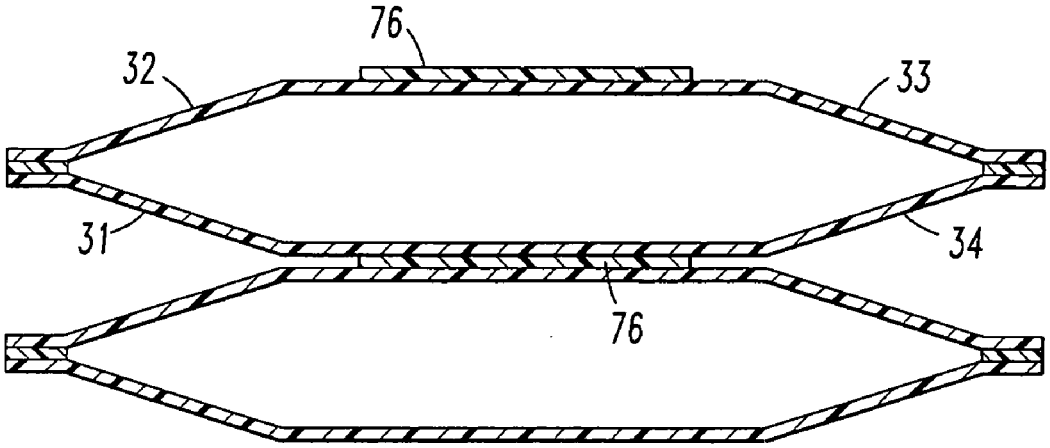
FIG. 9 is a side sectional view of two tabbed cells showing attachment of adjacent cells by a single strip of adhesive.
Figure 10:
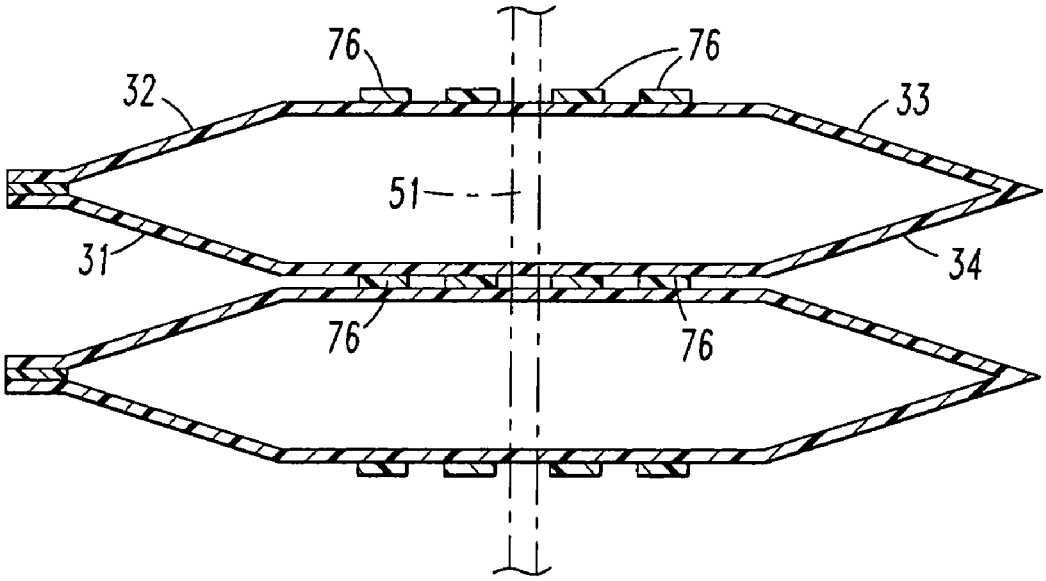
FIG. 10 is a side sectional view of two tabbed cells showing attachment of adjacent cells by several lines or beads of adhesive and a preferred location of a lift cord shown in dotted line.

As shown in FIG. 6, a tabbed, cellular panel 26 is attached between a headrail 50 and bottomrail 52. The uppermost cell is attached to the headrail. An insert or slat 56 fits through the lowermost cell and that assembly is attached to the main housing 57 of the bottomrail 52. Lift cords or pullcords 51 extend from the bottomrail 52, also called the lower rail assembly through the cellular material 26 and into the headrail 50, also called the upper rail assembly. The lift cords may pass through a cord lock 53 and the front face of the headrail as shown or may be attached to a tube lift (not shown). Typically, at least two lift cords are used for each window covering. Each lift cord 51 passes through the centerline of the cells with the glue lines 76 being approximately equidistant from that centerline. The glue lines extend the full width of the cellular material and define the front and rear limits or edges of the interconnection zones or the middle sides of the six-sided cells. Adjacent cells may be attached by a single strip of adhesive 76 as shown in FIG. 9 or by several glue lines 76 as shown in FIG. 10. I prefer to provide at least two spaced apart glue lines forming at least two spaced apart attachment zones so that the lift cord may pass through holes cut between them as shown in FIGS. 6 and 10. With that arrangement drilling the cord holes is much easier. The hollow drill bit is less likely to become clogged and the glue lines act as guides to direct the drill bit through the fabric between them.

Figure 7:
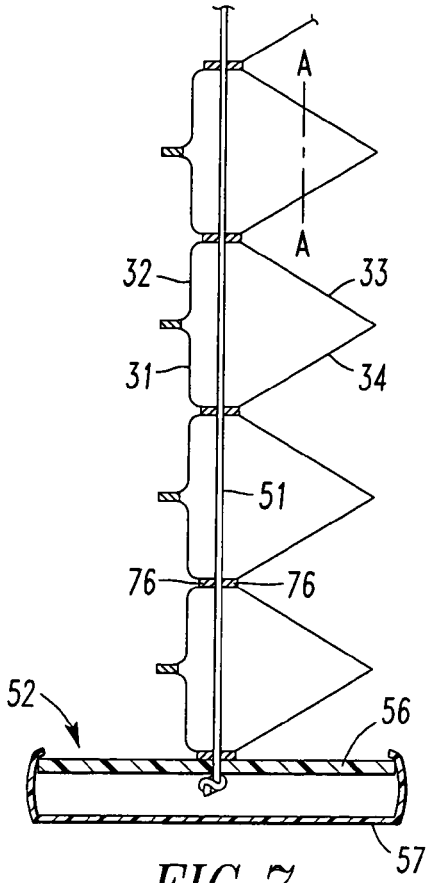
FIG. 7 is a side view of similar to FIG. 6 showing the lower portion of a window covering made from prismatic or D-shaped, tabbed, single cell material.
Figure 8:
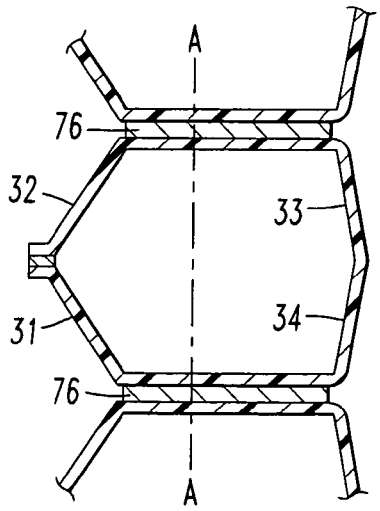
FIG. 8 is a side sectional view of another D-shaped, tabbed, single cell material.

The cells may be symmetrical like those shown in FIG. 6 or nonsymmetrical. In the embodiment shown in FIG. 7, the cells have a prismatic shape or D-shape. The interior angle defined between the front upper side 33 and the front lower side 34 is less than the interior angle between the rear upper side 32 and the rear lower side 31. In the symmetrical cells shown in FIG. 6, these angles are approximately equal. The symmetrical cells in FIG. 6 are connected so that a centerline through interconnection zone 54 will be collinear with a centerline through the cells. However, in the cell shapes of FIGS. 7 and 8, a centerline through the interconnection zone is rearward or forward of a centerline through the cells. The centerline through the cells is indicated by dotted line A—A in FIGS. 7 and 8. In all of the cellular structures shown in the drawings, the interconnection zones in each cellular panel are parallel to one another and equal in length. Consequently, the panel will have a uniform appearance from top to bottom when hung.

A variety of fabrics could be used to make the cellular structure. However, the industry has tended to use less expensive, non-woven fabrics made from synthetic materials, particularly polyester fabrics. Those skilled in the art will also recognize that several different adhesives could be used. One suitable adhesive is moisture cured cross-linking polyurethane adhesive. One could also use a hot-melt thermoplastic polyester UV-stabilized adhesive.

Even though I prefer to make the tabbed cellular structure in the manner illustrated and described here, other techniques could be used. Sonic welding could be used rather than adhesives. The stack could be constructed and cut to create only one cellular structure and fabric pieces rather than two panels of fabric. Strips of a hot melt glue could be applied to the fabric before the fabric is folded to form the stack.

Although I have shown certain present preferred embodiments of my method and the pleated and honeycomb structures made therefrom, it should be distinctly understood that my invention is not limited thereto, but may be variously embodied within the scope of the following claims.

I claim:

1. A cellular shade for covering a window, said shade comprising:

a plurality of interconnected fabric cells, wherein each cell within said plurality of cells is comprised of a nonwoven fabric and has:

a front side and a rear side;

a crease forming a tip on said front side;

an upper cell wall extending from said tip and having a rear edge, said upper cell wall having an upper surface and an interior surface and having a longitudinal centerline equidistant along said upper cell wall from said tip and from said rear edge of said upper cell wall;

a lower cell wall extending from said tip and having a rear edge, said lower cell wall having a lower surface and an interior surface, said lower cell wall and said upper cell wall being substantially equal in length; and a fin on said rear side, wherein said fin is formed by joining a first portion of said interior surface of said upper cell wall adjacent said rear edge of said upper cell wall with a first portion of said interior surface of said lower cell wall adjacent said rear edge of said lower cell wall;

a high temperature adhesive on substantially all cells of said plurality of cells, said high temperature adhesive for connecting each cell of said substantially all cells to an adjacent cell of said plurality of cells;

an upper rail assembly, said upper rail assembly attached to an uppermost cell of said plurality of cells;

a lower rail assembly, said lower rail assembly attached to a lowermost cell of said plurality of cells; and a pullcord, said pullcord for raising and lowering one of said upper and lower rail assembly in relation to the other of said upper and lower rail assembly.

2. The cellular shade of claim 1, wherein said high temperature adhesive extends longitudinally along said upper surface of said upper cell wall of said cell.

3. The cellular shade of claim 2, wherein said first portion of said interior surface of said upper cell wall adjacent said rear edge of said upper cell wall is joined with said first portion of said interior surface of said lower cell wall adjacent said rear edge of said lower cell wall by a high temperature adhesive.

4. The cellular shade of claim 3, wherein when said cellular shade is extended, a second portion of said interior surface of said upper cell wall and a second portion of said interior surface of said lower cell wall define a six-sided polygon, said six-sided polygon having an upper rear side, an upper middle side, an upper front side, a lower front side, a lower middle side, and a lower rear side.

5. The cellular shade of claim 4, wherein said fin, said upper middle side and said lower middle side are substantially in parallel arrangement.

6. The cellular shade of claim 4, wherein an interior angle defined by said upper front side and said lower front side is less than an interior angle defined by said upper rear side and said lower rear side.

7. The cellular shade of claim 4, wherein an interior angle defined by said upper front side and said lower front side is approximately equal to an interior angle defined by said upper rear side and said lower rear side.

8. The cellular shade of claim 5, wherein said upper middle side is approximately equal in length to said lower middle side.

9. The cellular shade of claim 8, wherein said high temperature adhesive on substantially all cells of said plurality of cells is on said upper surface of said upper cell wall of each cell of said substantially all cells and defines an interconnection zone for each cell of said substantially all cells, said interconnection zone having an interconnection centerline, and wherein said interconnection centerline is located forward of said longitudinal centerline on said upper surface.

10. A cellular shade for covering a window, said shade comprising:

a plurality of longitudinally extending, substantially parallel interconnected fabric cells, wherein substantially all cells within said plurality of cells have for each cell:

a front side and a rear side;

a crease forming a tip on said front side;

an upper cell wall extending from said crease and having a rear edge, said upper cell wall having a longitudinal center line equidistant along said upper cell wall from said crease and from said rear edge of said upper cell wall;

a lower cell wall extending from said crease and having a rear edge, said lower cell wall and said upper cell wall being substantially equal in length; and a fin on said rear side, wherein said fin is formed by joining a portion of said upper cell wall adjacent said rear edge of said upper cell wall with a portion of said lower cell wall adjacent said rear edge of said lower cell wall; and material located on at least one of said upper cell wall and said lower cell wall for attaching each cell of said plurality of cells to an adjacent cell of said plurality of cells.

11. The cellular shade of claim 10, wherein said material for attaching includes an adhesive strip.

12. The cellular shade of claim 11, wherein said adhesive strip passes through said longitudinal center line of said upper cell wall.

13. The cellular shade of claim 10, wherein said material for attaching includes at least one glue bead.

14. The cellular shade of claim 13, wherein said at least one glue bead passes through said longitudinal center line of said upper cell wall.

15. The cellular shade of claim 10, wherein said material for attaching includes a glue bead on each side of said longitudinal center line of said upper cell wall.

16. The cellular shade of claim 15, wherein said glue beads are approximately equidistant along said upper cell wall from said longitudinal center line of said upper cell wall.

17. The cellular shade of claim 10, wherein said portion of said upper cell wall adjacent said rear edge of said upper cell wall is joined with said portion of said lower cell wall adjacent said rear edge of said lower cell wall by a glue bead.

18. The cellular shade of claim 10, wherein said portion of said upper cell wall adjacent said rear edge of said upper cell wall is joined with said portion of said lower cell wall adjacent said rear edge of said lower cell wall by an adhesive strip.

19. The cellular shade of claim 10, wherein said portion of said upper cell wall adjacent said rear edge of said upper cell wall is joined with said portion of said lower cell wall adjacent said rear edge of said lower cell wall by sonic welding.

20. The cellular shade of claim 10, wherein when said cellular shade is extended, the interior surfaces of said upper cell wall and said lower cell wall define a six-sided polygon, said six-sided polygon having an upper rear side, an upper middle side, an upper front side, a lower front side, a lower middle side, and a lower rear side.

21. The cellular shade of claim 20, wherein said fin, said upper middle side and said lower middle side are substantially in parallel arrangement.

22. The cellular shade of claim 20, wherein an interior angle defined by said upper from side and said lower front side is less than an interior angle defined by said upper rear side and said lower rear side.

23. The cellular shade of claim 20, wherein said upper middle side is approximately equal in length to said lower middle side.

24. A cellular shade for covering a window, said shade comprising:

a plurality of longitudinally extending interconnected fabric cells, wherein each cell within said plurality of cells has:

a front side and a rear side;

a crease forming a tip on said front side;

an upper cell wall extending from said tip and having a rear edge, said upper cell wall having an upper surface and an interior surface and having a longitudinal center line equidistant along said upper cell wall from said tip and from said rear edge of said upper cell wall;

a lower cell wall extending from said tip and having a rear edge, said lower cell wall having a lower surface and an interior surface, said lower cell wall and said upper cell wall being substantially equal in length; and a fin on said rear side, wherein said fin is formed by joining a first portion of said interior surface of said upper cell wall adjacent said rear edge of said upper cell wall with a first portion of said interior surface of said lower cell wall adjacent said rear edge of said lower cell wall;

an adhesive on substantially all cells of said plurality of cells, said adhesive for connecting each cell of said substantially all cells to an adjacent cell of said plurality of cells;

an upper rail assembly, said upper rail assembly attached to an uppermost cell of said plurality of cells;

a lower rail assembly, said lower rail assembly attached to a lowermost cell of said plurality of cells; and a pullcord, said pullcord for raising and lowering one of said upper and lower rail assembly in relation to the other of said upper and lower rail assembly.

25. The cellular shade of claim 24, wherein said adhesive includes an adhesive strip on said upper surface of said upper wall.

26. The cellular shade claim 25, wherein said adhesive strip passes through said longitudinal center line of said upper cell wall.

27. The cellular shade of claim 24, wherein said adhesive includes an adhesive strip on said lower surface of said lower cell wall.

28. The cellular shade of claim 24, wherein said adhesive includes a glue bead on said upper surface of said upper cell wall.

29. The cellular shade of claim 28, wherein said glue bead passes through said longitudinal center line of said upper cell wall.

30. The cellular shade of claim 24, wherein said adhesive includes a first glue bead on said upper surface of said upper cell wall and a second glue bead on said upper surface of said upper cell wall, said first and said second glue beads being on opposite sides of said longitudinal center line of said upper cell wall.

31. The cellular shade of claim 30, wherein said first and said second glue beads extend longitudinally along said upper surface of said upper cell wall of said cell.

32. The cellular shade of claim 31, wherein said first portion of said interior surface of said upper cell wall adjacent said rear edge of said upper cell wall is joined with said first portion of said interior surface of said lower cell wall adjacent said rear edge of said lower cell wall by an adhesive.

33. The cellular shade of claim 32, wherein when said cellular shade is extended, a second portion of said interior surface of said upper cell wall and a second portion of said interior surface of said lower cell wall define a six-sided polygon, said six-sided polygon having an upper rear side, an upper middle side, an upper front side, a lower front side, a lower middle side, and a lower rear side.

34. The cellular shade of claim 33, wherein said fin, said upper middle side and said lower middle side are substantially in parallel arrangement.

35. The cellular shade of claim 33, wherein an interior angle defined by said upper front side and said lower front side is less than an interior angle defined by said upper rear side and said lower rear side.

36. The cellular shade of claim 35, wherein said first and said second glue beads are approximately equidistant along said upper cell wall from said longitudinal center line of said upper cell wall.

37. The cellular shade of claim 36, wherein said first glue bead is proximate to a front end of said upper middle side and said second glue bead is proximate to a rear end of said upper middle side.

38. The cellular shade of claim 37, wherein said upper middle side is approximately equal in length to said lower middle side.

39. The cellular shade of claim 24, wherein said adhesive includes a first glue bead on said lower surface of said lower cell wall and a second glue bead on said lower surface of said lower cell wall.

40. The cellular shade of claim 39, wherein when said cellular shade is extended, a second portion of said interior surface of said upper cell wail and a second portion of said interior surface of said lower cell wall define a six-sided polygon, said six-sided polygon having an upper rear side, an upper middle side, an upper front side, a lower front side, a lower middle side, and a lower rear side.

41. The cellular shade of claim 40, wherein said fin, said upper middle side and said lower middle side are substantially in parallel arrangement.

42. The cellular shade of claim 39, wherein an interior angle defined by said upper front side and said lower front side is less than an interior angle defined by said upper rear side and said lower rear side.

43. The cellular shade of claim 39, wherein said upper middle side is approximately equal in length to said lower middle side.

44. The cellular shade of claim 43, wherein said first glue bead is proximate to a front end of said lower middle side and said second glue beads is proximate to a rear end of said lower middle side.

45. The cellular shade of claim 44, wherein said first and said second glue beads extend longitudinally along said lower surface of said lower cell wall of said cell.

46. The cellular shade of claim 45 wherein said first portion of said interior surface of said upper cell wall adjacent said rear edge of said upper cell wall is joined with said first portion of said interior surface of said lower cell wall adjacent said rear edge of said lower cell wall by an adhesive.

* * * * *

UNITED STATES PATENT AND TRADEMARK OFFICE

CERTIFICATE OF CORRECTION

PATENT NO. : 7,159,634 B1
APPLICATION NO. : 09/017392
DATED : January 9, 2007
INVENTOR(S) : Ren Judkins It is certified that error appears in the above-identified patent and that said Letters Patent is hereby corrected as shown below:

Column 7, claim 22, line 57, change “from” to --front--.

Column 9, claim 40, line 25, change “wail” to --wall--.

Signed and Sealed this

Tenth Day of April, 2007

JON W. DUDAS
*Director of the United States Patent and Trademark Office*